United States Patent [19]

Ford et al.

[11] 4,111,026

[45] Sep. 5, 1978

[54] STEPPED CONE DRAW BLOCK

[75] Inventors: Wilson Ford, Wheatridge; John Temple Gagnon, Arvada, both of Colo.

[73] Assignee: Coors Porcelain Company, Golden, Colo.

[21] Appl. No.: 839,873

[22] Filed: Oct. 6, 1977

[51] Int. Cl.[2] ..... B21C 1/14

[52] U.S. Cl. ..... 72/289

[58] Field of Search ..... 72/280, 287, 289; 242/78; 74/230.3

[56] References Cited

U.S. PATENT DOCUMENTS

| | | | |
|---|---|---|---|
| 3,432,146 | 3/1969 | Schubert et al. | 74/230.3 |
| 3,618,357 | 11/1971 | Beninga | 72/289 |

FOREIGN PATENT DOCUMENTS

| | | | |
|---|---|---|---|
| 1,231,655 | 1/1967 | Fed. Rep. of Germany | 72/289 |
| 691,019 | 5/1953 | United Kingdom | 74/230.3 |
| 284,957 | 10/1970 | U.S.S.R. | 72/289 |
| 341,556 | 6/1972 | U.S.S.R. | 72/289 |

*Primary Examiner*—Michael J. Keenan

*Attorney, Agent, or Firm*—Reising, Ethington, Barnard, Perry & Brooks

[57] ABSTRACT

A stepped cone draw block disclosed has intermediate sheaves which each include a pair of plate-like annular sheave members with peripheral flanges between which a ceramic ring for drawing a wire is clamped. Side surfaces of the sheave members of each intermediate sheave face away from each other along an axis of a shaft on which the draw block is mounted and axially facing surfaces of these sheave members are bolted in engagement with each other midway between the side surfaces. One sheave member of each intermediate sheave has a central opening sized to receive and mount the sheave on the shaft with a shaft key received within a keyway of the opening to provide coupling to the shaft, while the other sheave member has an opening slightly larger than the shaft and a groove aligned with but slightly larger than the keyway so as to facilitate mounting of the sheave. In one embodiment, the ceramic ring has a round inner surface with a semicircular slot which is aligned with a complementary semicircular slot of the sheave to receive a pin that prevents rotation therebetween. In another embodiment, the ceramic ring has an inner surface with a round portion and a flat portion that engage complementary surface portions on the sheave members to prevent relative rotation therebetween. Two of the smallest sheaves are formed by a unitary ceramic member with a central opening for receiving the shaft and a keyway formed by a polyurethane plug.

10 Claims, 6 Drawing Figures

STEPPED CONE DRAW BLOCK

BACKGROUND OF THE INVENTION

1. Field of the Invention

This invention relates to draw blocks for use in wire drawing operations.

2. Description of the Prior Art

Stepped cone draw blocks are conventionally utilized for drawing wire through dies with openings of progressively increasing sizes. Sheaves of the draw block receive the wire as it is drawn through the dies. Due to the tension of the wire as it is being drawn, it is important for the sheaves to have hard outer surfaces that have good resistance to wear during use. Ceramic rings have previously been utilized to provide the sheave surfaces as shown by U.S. Pat. Nos. 3,432,146 and 3,621,698.

SUMMARY OF THE INVENTION

An object of the present invention is to provide a stepped cone draw block used for drawing wire and having an improved sheave construction as well as improved ceramic rings that are clamped between peripheral flanges of sheave members of the sheaves.

In carrying out the above object, intermediate sheaves of the stepped cone draw block have round plate-like sheave members with aligned central openings for receiving a shaft on which the draw block is mounted. Axial side surfaces of these sheave members face away from each other along the axis of the shaft and engaged axially facing surfaces thereof are located midway between the side surfaces. Bolts clamp the sheave members of each of these intermediate sheaves to each other and annular peripherial flanges thereof are spaced axially with a ceramic ring clamped therebetween to receive a wire during a wire drawing operation.

Both sheave members of the intermediate sheaves have central openings that receive the shaft on which the draw block is mounted. One of the openings has a diameter sized to mount the sheave on the shaft and includes a keyway that receives a key of the shaft to couple the sheave to the shaft. The other opening has a larger size and a groove aligned with the keyway but also of a larger size so as to facilitate the axial movement of the sheave along the shaft during mounting.

One embodiment of the ceramic sheave ring has spaced side surfaces which connect a wire receiving round outer surface thereof to a round inner surface. A semicircular slot along the round inner surface extends between the side surfaces parallel to a central axis of the ring and receives a pin that is also received by a semicircular slot in at least one of the sheave members. It has been found that locating the pin within a slot of the one sheave member that has the larger central opening provides good dynamic balance to the sheave. Another embodiment of the ceramic ring also has side surfaces that extend from a round outer surface to an inner surface which has a round portion and a flat portion. Complementary round and flat mounting surface portions of one or both sheave members are received within the round inner surface of this ring in engagement therewith to prevent rotation between the ring and the sheave.

The two smallest sheaves of the draw block are provided by a unitary ceramic member with a central opening that receives the shaft on which the draw block is mounted. A metal flange is located adjacent one smaller sheave surface of the ceramic member and a groove is located within the opening adjacent a larger sheave surface. A synthetic resin plug preferably of polyurethane is received within the groove and forms a keyway that receives the shaft key to couple the ceramic member to the shaft. A single sheave with sheave members between which a ceramic ring is adhesively bonded can alternately be utilized to replace the unitary ceramic member with two sheaves. Another sheave with sheave members and a ceramic ring adhesively bonded therebetween is located between either the ceramic member with the two sheaves or the single sheave with the adhesively bonded ceramic ring and the smallest intermediate sheave with the annular plate-like sheave members that are bolted to each other. The two largest sheaves include annular sheave members bolted to each other to clamp ceramic rings therebetween and the larger one is bolted onto the smaller one so as to shorten the required length of shaft necessary to mount the draw block for use in the wire drawing operation.

The objects, features, and advantages of the present invention are readily apparent from the following detailed description of the preferred embodiments taken in connection with the accompanying drawings.

DETAILED DESCRIPTION OF THE PREFERRED EMBODIMENTS

Figure 1:
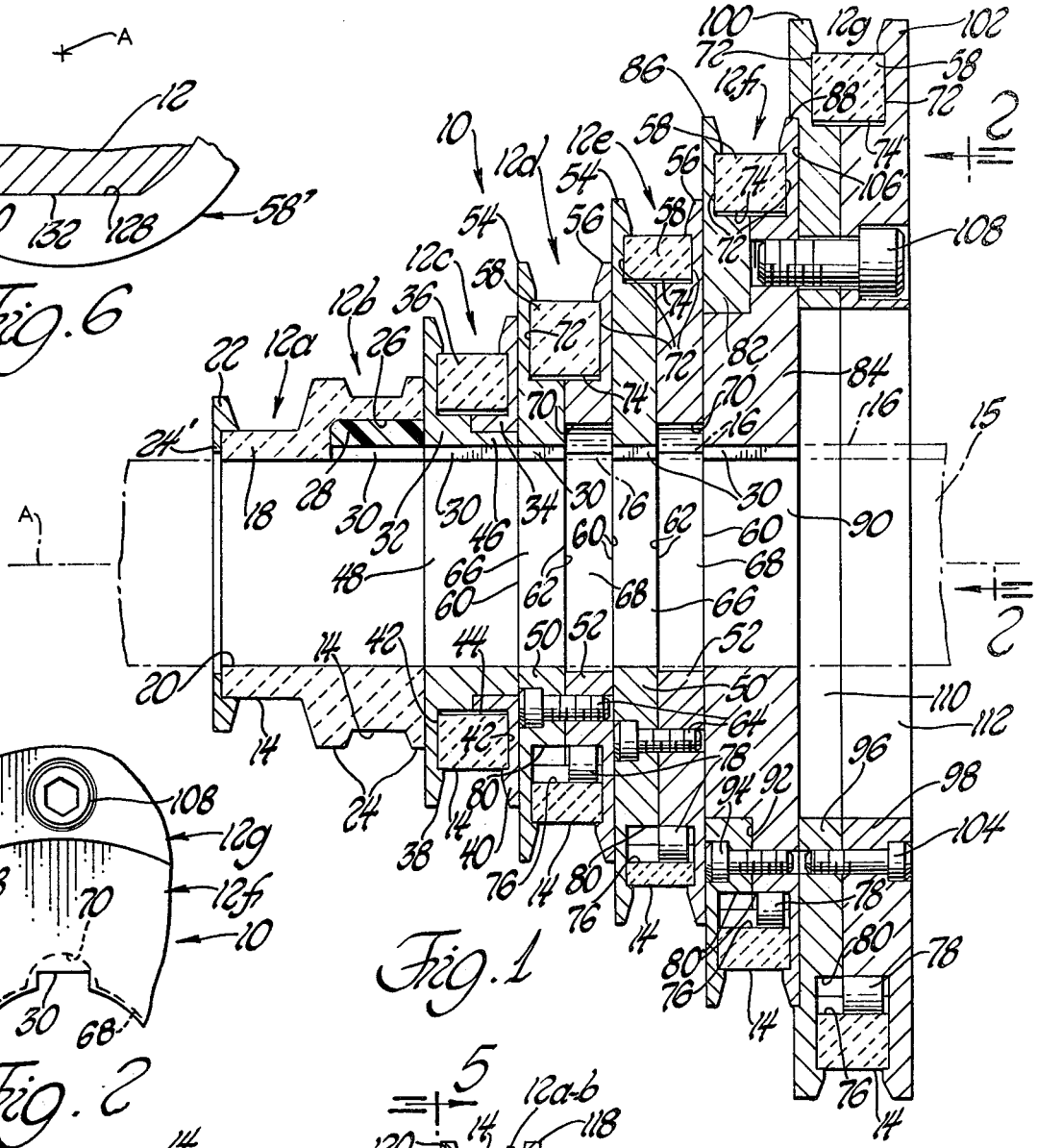
FIG. 1 is a sectional view of a stepped cone draw block constructed according to the present invention.

With reference to FIG. 1, a stepped cone draw block constructed according to the present invention is generally indicated by 10 and includes sheaves 12*a, b, c, d, e, f,* and *g* that receive the wire during a wire drawing operation. Round outer ceramic surfaces 14 of the sheaves have a progressively increasing diameter from the sheaves at the left toward the sheaves at the right so as to accommodate for the increased wire length as the wire is drawn through die openings of progressively decreasing sizes. A phantom line indicated shaft 15 mounts the draw block for rotation about a central axis A of the shaft and a shaft key 16 also shown by phantom line representation couples the sheaves of the draw block to the shaft in a manner that is hereinafter described.

The sheaves 12*a* through *g* will now be described beginning with the smallest ones and proceeding toward the larger ones. A unitary ceramic member 18 defines the round sheave surfaces 14 of the two smallest sheaves 12*a* and *b*. A round central opening 20 of ceramic member 18 has a diameter that is sized to receive the shaft 15 and provide mounting of this ceramic member on the shaft. An annular metallic flange 22 is adhesively bonded to the left end of ceramic member 18 so as to cooperate with the surface 14 of sheave 12*a* in defining a sheave groove. An inwardly projecting porton 24' of flange 22 distributes axial loading forces to the member 18 as such forces are applied to the draw block to retain the sheaves at a fixed location along the length of shaft 15. Integrally formed annular flanges 24 of ceramic member 18 define the sides of the sheave groove for sheave 12*b*. A groove 26 formed in ceramic member 18 faces inwardly along the opening 20 and is aligned with the larger diameter sheave surface 14 of sheave 12*b*. Within the groove 26, a synthetic resin plug 28 is adhesively bonded and is preferably of a polyurethane material. Plug 28 defines a keyway 30 that receives the shaft key 16 through its right open end.

Sheave 12*c* shown in FIG. 1 includes a pair of annular metallic sheave members 32 and 34 as well as a ceramic ring 36 that is adhesively bonded between axially spaced peripherial flanges 38 and 40 of the sheave members. Ceramic ring 36 has spaced side surfaces 42 engaged by the flanges 38 and 40 as are the axial ends of the outer ring surface 14. A round inner surface 44 of the ceramic ring connects the side surfaces. Sheave member 32 includes an axially projecting portion 46 that is received within the interior of sheave member 34. A round opening 48 of sheave member 32 receives the shaft 15 to mount the sheave 12*c* and defines a keyway 30 that is aligned with the keyway 30 of the ceramic member 18 so as to receive the shaft key 16 and couple the sheave member to the shaft.

Figure 2:
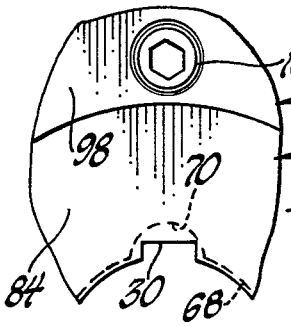
FIG. 2 is a partial end view of the draw block taken along line 2—2 of FIG. 1.

Intermediate sheaves 12*d* and 12*e* have the same construction as each other except for their respective diameters. As such, these two sheaves will be described utilizing the same reference numerals. Each sheave 12*d* and 12*e* includes a pair of round plate-like sheave members 50 and 52 of a suitable metallic material which is preferably steel. Annular peripherial flanges 54 and 56 clamp a round ceramic ring 58 in position for receiving wire being drawn on its round outer surface 14. Axially facing planar side surfaces 60 on the sheave members 54 and 56 of each sheave face away from each other along the axis A of shaft rotation. Axially facing planar surfaces 62 on the sheave members 54 and 56 are located midway between the side surfaces 60 thereof maintained in engagement with each other by a plurality of circumferentially spaced bolts 64, only one shown. Central openings 66 and 68 of the sheave members 54 and 56 receive the shaft 15. Opening 66 has a round shape with a diameter sized to mount the sheave on the shaft 15 and includes a keyway 30 aligned with the other keyways to receive the shaft key 16. Opening 68 also has a round shape but with a slightly larger diameter than opening 66 and also includes a groove 70 aligned with the adjacent keyway 30 but of a larger size, see also FIG. 2. During mounting of the sheaves 12*d* and 12*e* on the shaft 15, the sheave members 52 do not engage the shaft due to the sizes of their openings 68 and grooves 70 so as to facilitate the relative axial movement between the shaft and the sheave members.

Figure 3:
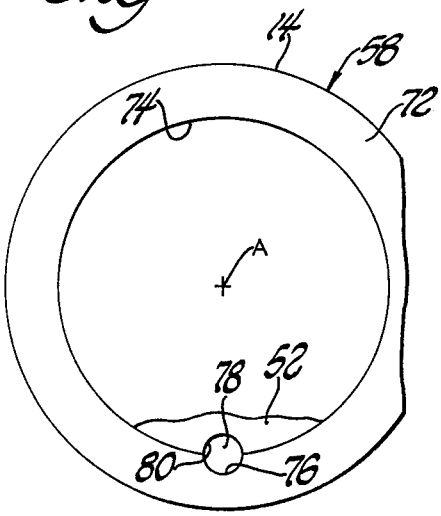
FIG. 3 is a view of ceramic rings utilized with sheaves of the draw block.

The structure of ceramic ring 58 is best understood by combined reference to FIGS. 1 and 3. Axially spaced side surfaces 72 of ring 58 connect the round outer surface 14 thereof with a round inner surface 74. Along the inner surface 74, the ceramic ring 58 includes a slot 76 that extends parallel to the axis A with a generally semicircular cross-section receiving a round pin 78. A complementary semicircular slot 80 in one or both of the sheave members 50 and 52 receives the pin 78 so as to cooperate therewith in preventing rotation of the ceramic ring with respect to the sheave members. Good dynamic balance characteristics have been found to result if the pin 78 is located within the slot 80 of the sheave member 52 which is itself not engaged with the shaft 15 due to the sizes of its opening 68 and groove 70.

Sheave 12*f* includes a pair of metallic annular sheave members 82 and 84 that have peripherial flanges 86 and 88 for clamping a ceramic ring 58 of the structure previously described. Sheave member 84 includes a central opening 90 of a round shape that has a size for mounting this sheave on the shaft 15 and also includes a keyway 30 aligned with the other keyways to receive the shaft key 16 and provide the coupling thereof to the shaft. An annular outer ledge 92 of sheave member 84 receives the sheave member 82 which is retained thereto by a plurality of bolts 94, only one of which is shown, in order to clamp the ceramic ring 58. A pin 78 and slots 76 and 80 prevent rotation of the ceramic ring with respect to the sheave members in the manner previously described.

Sheave 12*g* includes a pair of annular metallic sheave members 96 and 98 that clamp a ceramic ring 58 between peripherial flanges 100 and 102. A plurality of circumferentially spaced bolts 104 (only one shown) secure the sheave members 96 and 98 to each other in an engaged condition. A relatively shallow axially facing depression 106 of the sheave member 96 receives the sheave member 84 of the sheave 12*f* and a plurality of larger circumferentially spaced bolts 108 (only one shown) secure the sheave 12*g* to the sheave 12*f*. Sheave members 96 and 98 have relatively large openings 110 and 112, respectively, that encircle the shaft 15 in a spaced relationship thereto so as to permit a nut or other retaining member on the shaft to be positioned within the confines thereof. This construction allows mounting of the draw block 10 on a relatively short length of shaft.

Figure 4:
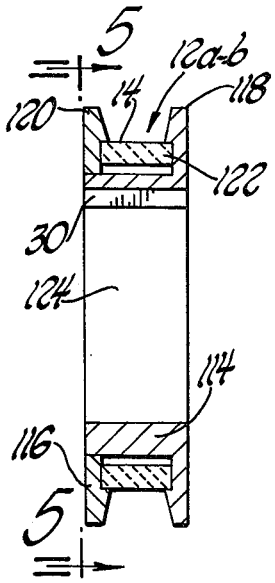
FIG. 4 is a sectional view of a sheave that is used as a replacement for the two smallest sheaves shown in FIG. 1.
Figure 5:
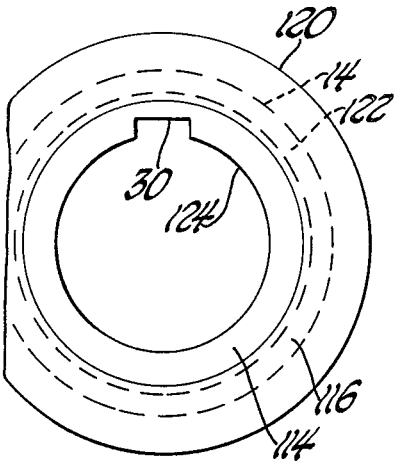
FIG. 5 is an end view of the sheave shown in FIG. 4 taken along line 5—5 thereof.

With reference to FIGS. 4 and 5 a sheave 12*a–b* shown is used as a replacement for the ceramic member 18 that defines the sheaves 12*a* and 12*b* in FIG. 1. Only six sheaves rather than the seven shown in FIG. 1 make up the draw block when sheave 12*a–b* is used. This sheave 12*a–b* has the same diameter as the sheave 12*b* in FIG. 1 and includes a pair of annular metallic sheave members 114 and 116. Peripherial flanges 118 and 120 of sheave members 114 and 116 are adhesively bonded to a ceramic ring 122 whose outer surface 14 receives the wire as it is drawn by the draw block. A central opening 124 of this sheave receives the shaft 15 and includes a keyway 30 that receives the shaft key to provide coupling to the shaft.

Figure 6:
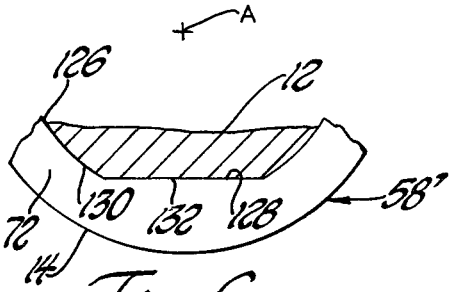
FIG. 6 is a partial view similar to FIG. 3 of an alternate embodiment of the ceramic ring.

An alternate embodiment of the ceramic ring for use with sheaves 12*d, e, f,* and *g* is shown in FIG. 6 and indicated by 58'. The round outer surface 14 of this ring is connected by axially spaced side surfaces 72 to an inner surface thereof which includes a round portion 126 and a flat portion 128 that connects opposite ends of the round portion. The sheave 12 utilized with this ring has a mounting surface with a round surface portion 130 and a flat surface portion 132 that respecttively engage the complementary ring surface portions as shown in order to prevent relative rotation between the sheave and the ring. Peripherial flanges of the sheave 12 clamp the ring side surfaces 72 in a similar manner to that described with the other ceramic ring.

While preferred embodiments of the stepped cone draw block and the sheaves thereof as well as the ceramic rings of this invention has herein been described in detail, those skilled in this art will recognize various alternative designs and embodiments for practicing the present invention as defined by the following claims.

We claim:

1. A stepped cone draw block for use in drawing wire, the draw block comprising: at least two sheaves each of which includes a pair of round plate-like sheave members having central aligned openings for receiving a shaft on which the sheave is to be mounted for rotation about a central axis of the shaft; said members of each sheave having axial side surfaces that face away from each other along the axis of shaft rotation and also having engaged axially facing surfaces located midway between the side surfaces; annular peripheral flanges on the sheave members spaced axially from each other; each sheave having a ceramic draw ring clamped between the peripheral flanges on the members thereof and the ring having an outer surface for receiving a wire during a wire drawing operation; and means for detachably securing the members of each of said sheaves to each other independently of the members of each other of said sheaves so as to provide clamping of the associated ceramic ring while allowing unclamping and replacement thereof without unclamping the ceramic ring of any other of said sheaves.

2. A stepped cone draw block sheave for use in drawing wire, the sheave comprising: a pair of round plate-like sheave members having central aligned openings for receiving a shaft on which the sheave is to be mounted for rotation about a central axis of the shaft; the central opening of one sheave member having a round shape of a diameter for receiving and mounting the sheave on the shaft and including a keyway for coupling the sheave to the shaft by a key thereof; the central opening of the other sheave member having a round opening of a larger diameter than the opening of the one sheave member and including a groove aligned with the keyway but of a larger size so as to facilitate mounting of the sheave on the shaft and key thereof; said sheave members having axial side surfaces that face away from each other along the axis of shaft rotation and also having engaged axially facing surfaces located midway between the side surfaces; annular outer peripherial flanges on the sheave members spaced axially from each other; and a ceramic draw ring clamped between the outer peripherial flanges and having an outer surface for receiving a wire during a wire drawing operation.

3. A draw block sheave as in claim 2 further including aligned generally semicircular slots in the ceramic draw ring and at least one of the sheave members and a pin received within the aligned slots to prevent rotation between the ring and the sheave members.

4. A draw block sheave as in claim 2 further including an inner surface on the ceramic ring having a round portion and a flat portion, and at least one of the sheave members including a mounting surface having a round portion and a flat portion received within the ceramic ring to prevent relative rotation between the sheave members and the ceramic ring.

5. A stepped cone draw block for use in drawing wire, the draw block comprising: a plurality of sheaves of progressively increasing diameters arranged in a side-by-side relationship; at least two of the sheaves being intermediate sheaves which each include a pair of plate-like annular sheave members having central aligned openings for receiving a shaft on which the sheave is to be mounted for rotation about a central axis of the shaft; the members of each of said intermediate sheaves having planar side surfaces that face axially away from each other in engagement with the adjacent sheaves and also having engaged axially facing planar surfaces located midway between the side surfaces; the sheave members of each of said intermediate sheaves having annular peripherial flanges spaced axially from each other; a ceramic draw ring located between the outer peripherial flanges on the sheave members of each intermediate sheave and having an outer surface for receiving a wire during a wire drawing operation; and bolts that clamp the sheave members of each intermediate sheave to each other to clamp the ceramic draw ring associated therewith between the peripherial flanges thereof.

6. A stepped cone draw block for use in drawing wire, the draw block comprising: a unitary ceramic member having first and second sheaves and including a central opening for receiving a shaft on which the draw block is mounted for rotation about a central axis of the shaft; said opening having a keyway for receiving a key of the shaft; a third sheave including a pair of annular sheave members and a ceramic draw ring bonded therebetween; said third sheave including a central opening for receiving the shaft and having a keyway for receiving the shaft key; fourth and fifth sheaves each of which includes a pair of plate-like annular sheave members having central aligned openings for receiving the shaft on which the sheave is to be mounted for rotation about the central axis of the shaft; the central opening of first sheave members of both the fourth and fifth sheaves having a diameter for receiving and mounting these sheaves on the shaft and including a keyway for coupling thereof to the shaft; the central openings of the other sheave members of the fourth and fifth sheaves each having a larger diameter than the openings of the first sheave members thereof and each including a groove aligned with the keyway of the associated sheave member but having a larger size so as to facilitate mounting of the fourth and fifth sheaves on the shaft; said plate-like sheave members having planar side surfaces that face axially away from each other in engagement with the adjacent sheaves and also having engaged axially facing planar surfaces located midway between the side surfaces; the plate-like sheave members of the fourth and fifth sheaves having annular peripherial flanges spaced axially from each other; ceramic draw rings clamped between the peripherial flanges on the sheave members of the fourth and fifth sheaves; a sixth sheave including a pair of annular sheave members and a ceramic ring clamped therebetween; said sixth sheave having a central opening for receiving the shaft and including a keyway for receiving the shaft key; a seventh sheave including a pair of annular sheave members and a ceramic ring clamped therebetween; and said first through seventh sheaves having outer ceramic surfaces of progressively increasing diameters for receiving a wire during a wire drawing operation.

7. A stepped cone draw block for use in drawing wire, the draw block comprising: first and second sheaves each of which includes a pair of sheave members and a ceramic ring bonded therebetween; said first and second sheaves each having a central opening for receiving a shaft and having a keyway for receiving a key of the shaft for rotation about a central axis of the shaft; third and fourth sheaves each of which includes a pair of plate-like annular sheave members having central aligned openings for receiving the shaft on which the sheave is to be mounted for rotation about the central axis of the shaft; the central opening of first sheave members of both the third and fourth sheaves being round with a diameter for receiving and mounting these sheaves on the shaft and including a keyway for coupling thereof to the shaft; the central openings of the other sheave members of the third and fourth sheaves each being round with a larger diameter than the openings of the first sheave members thereof and each including a groove aligned with the keyway of the associated sheave member but having a larger size so as to facilitate mounting of the third and fourth sheaves on the shaft; said plate-like sheave members having planar side surfaces that face axially away from each other in engagement with the adjacent sheaves and also having engaged axially facing planar surfaces located midway between the side surfaces; the plate-like sheave members of the third and fourth sheaves having annular peripherial flanges spaced axially from each other; ceramic draw rings clamped between the peripherial flanges on the sheave members of the third and fourth sheaves; a fifth sheave including a pair of annular sheave members and a ceramic ring clamped therebetween; said fifth sheave having a central opening for receiving the shaft and including a keyway for receiving the shaft key; a sixth sheave including a pair of annular sheave members and a ceramic ring clamped therebetween; and said first through sixth sheaves having outer ceramic surfaces of progressively increasing diameters for receiving a wire during a wire drawing operation.

8. A draw ring for use with a stepped cone draw block in a wire drawing operation, the draw ring comprising: a ceramic body having a round outer surface extending about a central axis of the ring; a round inner surface on the ceramic body extending about the central axis and including a slot that extends parallel to the axis with a generally semicircular cross-section that opens inwardly toward the axis so as to be adapted to receive a pin for coupling the ring to a sheave; and spaced side surfaces on the ceramic body connecting the inner and outer surfaces, said semicircular slot in the inner surface extending between the spaced side surfaces of the ring.

9. A draw ring for use with a stepped cone draw block in a wire drawing operation, the draw ring comprising: a ceramic body having a round outer surface extending about a central axis of the ring; an inner surface on the ceramic body extending about the axis and including a round surface portion and a flat surface portion; the round surface portion having opposite ends connected by the flat surface portion in a manner that permits rotational driving of the ring at the flat surface portion; and spaced side surfaces on the ceramic body connecting the inner and outer surfaces.

10. A stepped cone draw block sheave comprising a unitary ceramic member having first and second round outer sheave surfaces and a central opening for receiving and mounting the member on a shaft, the first sheave outer surface having a smaller diameter than the second sheave outer surface, a slot in the ceramic member facing inwardly along the opening aligned with the second sheave outer surface, and a synthetic resin plug within the groove having a keyway for receiving a key of the shaft to provide coupling of the ceramic member to the shaft.

* * * * *